US006685556B1

(12) United States Patent
Bertin

(10) Patent No.: US 6,685,556 B1
(45) Date of Patent: Feb. 3, 2004

(54) AUTOMATIC MODULAR OUTLETS FOR CONDITIONED AIR, DAMPERS, AND MODULAR RETURN AIR GRILLS

(76) Inventor: Ira L. Bertin, 4500—19th St., #275, Boulder, CO (US) 80304

( * ) Notice: Subject to any disclaimer, the term of this patent is extended or adjusted under 35 U.S.C. 154(b) by 0 days.

(21) Appl. No.: 10/288,790

(22) Filed: Nov. 6, 2002

(51) Int. Cl.[7] ..... F24F 7/00
(52) U.S. Cl. ..... 454/256; 454/248
(58) Field of Search ..... 454/248, 256, 454/258, 254, 270, 314

(56) References Cited

U.S. PATENT DOCUMENTS

| | | | | | |
|---|---|---|---|---|---|
| 1,459,318 | A | * | 6/1923 | Birdsall | 236/35.2 |
| 2,621,578 | A | * | 12/1952 | Labus | 454/314 |
| RE23,884 | E | * | 10/1954 | Kennedy | 454/314 |
| 3,060,832 | A | * | 10/1962 | Wright et al. | 454/314 |
| 3,436,016 | A | * | 4/1969 | Edwards | 236/49.5 |
| 3,509,613 | A | * | 5/1970 | Koenig | 29/890.14 |
| 3,847,066 | A | * | 11/1974 | Van Der Ham | 454/258 |
| 3,908,528 | A | * | 9/1975 | Bertin et al. | 454/314 |
| 3,937,133 | A | * | 2/1976 | Bertin et al. | 454/320 |
| 4,290,554 | A | * | 9/1981 | Hensley | 236/49.5 |
| 4,493,456 | A | * | 1/1985 | Sarazen et al. | 236/49.5 |
| 5,501,634 | A | * | 3/1996 | Wilder | 454/136 |
| 5,556,335 | A | * | 9/1996 | Holyoake | 454/258 |
| 5,913,723 | A | * | 6/1999 | Ribo | 454/233 |

FOREIGN PATENT DOCUMENTS

DE 26 30 504 7/1976

* cited by examiner

*Primary Examiner*—Derek Boles
(74) *Attorney, Agent, or Firm*—Emery L. Tracy

(57) ABSTRACT

A module for use as a part of an outlet for conditioned air and to support, be supported by, or connected to another part of the outlet. The module comprises a module frame and at least one deflection damper pivotally mounted vertically within the module frame. At least one trajectory vane is pivotally mounted horizontally within the module frame. An adjusting mechanism is secured within each trajectory vane for adjusting the angle of each trajectory vane relative to the module frame responding to the temperature of the supply conditioned air.

25 Claims, 14 Drawing Sheets

AIRSENSE: SIDEWALL FRAMES
FOR AUTOMATIC SUPPLY REGISTERS
AND RETURN AIR GRILLES

Sidewall frames may also be used for ceiling applications

AUTOMATIC MODULAR OUTLETS FOR CONDITIONED AIR, DAMPERS, AND MODULAR RETURN AIR GRILLS

BACKGROUND OF THE INVENTION

1. Field of the Invention

This invention relates generally to energy saving modular outlets for conditioned air, dampers, and modular return air grills and, more particularly, the invention relates to automatic modular outlets for conditioned air which adjust the directional flow of the conditioned air depending on the temperature of the supply conditioned air.

2. Description of the Prior Art

The delivery of conditioned air into a space from a duct opening through an outlet in the ceiling or side walls requires the use of an air outlet that must enable the volume and direction of the air to be adjusted to ensure its proper distribution throughout the served space. The use of large capacity air conditioners has introduced new problems in diffusing conditioned air as they necessitate larger diffusers with the diffuser size depending on the capacity of the air conditioner and the size of the ceiling or wall mounted outlet but with the troublesome requirement that they be quiet in operation in spite of the increase in the volume of the conditioned air. By way of example, air conditioners rated at 75 tons or more capacity are commonly used at the present time and static pressures are often in the range of three (3) inches in order to accommodate the massive air distribution duct system.

Accordingly, there exists a need for air outlets, particularly those that are air diffusers and registers, that are quiet in operation regardless of the capacity of the air conditioners or the static pressure in the system. Additionally, a need exists for air outlets of modular constructions thereof that make any size requirement easily attainable independently of the size of the outlet of the air duct or the capacity of the air conditioner with which the duct is in communication. Furthermore, there exists a need for air diffusers and-registers-which automatically adjust the airflow direction depending on the temperature of the conditioned air passing therethrough.

SUMMARY

The present invention is a module for use as a part of an outlet for conditioned air and to support, be supported by, or connected to another part of the outlet. The module comprises a module frame and at least one deflection damper pivotally mounted vertically within the module frame. At least one trajectory vane is pivotally mounted horizontally within the module frame. Adjusting means are secured within each trajectory vane for adjusting the angle of each trajectory vane relative to the module frame responding to the temperature of the supply conditioned air.

In addition, the present invention includes an air diffuser or register for directing conditioned air. The air diffuser or register comprises vertical directing means for directing the conditioned air and horizontal directing means for directing the conditioned air. Adjusting means are associated with the horizontal directing means for moving the horizontal directing means in an upward or downward direction responding to the temperature of the supply conditioned air.

Furthermore, the present invention includes a method of directing conditioned air. The method comprises providing a trajectory vane, encasing at least a portion of a thermostatic bimetal strip within the trajectory vane, directing the conditioned air across the trajectory vane, automatically moving the trajectory vane in a generally downward manner for heated conditioned air, and automatically moving the trajectory vane in a generally upward manner for cooled conditioned air.

DETAILED DESCRIPTION OF THE PREFERRED EMBODIMENTS

As illustrated in FIGS. 1–28, the present invention is an air diffuser or supply register, indicated generally at 10, incorporating a mounting frame 11 for mounting to or within a suspended ceiling and sealed to an outlet end of a duct for conditioned air. The air diffusers 10 of the present invention are designed to be modular such that multiple air diffusers 10 can be configured depending on the need of the consumer for conditioned air. U.S. Pat. No. 3,937,133, owned by the same owner of the present application, describes the mounting of an air diffuser to a ceiling and the modular capabilities and benefits, and is hereby herein incorporated by reference.

Figure 1:
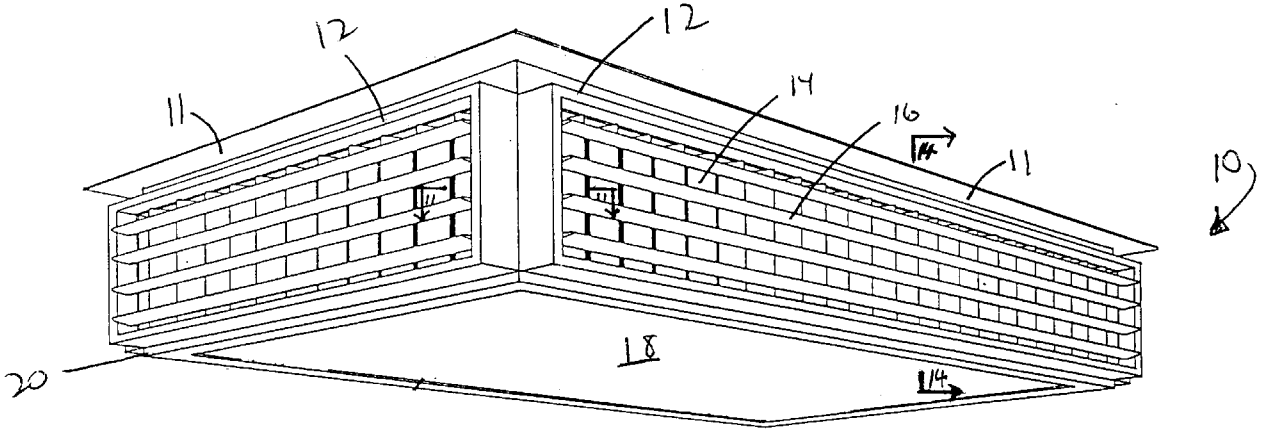
FIG. 1 is a perspective view illustrating a ceiling mounted automatic supply air diffuser, constructed in accordance with the present invention, with a solid interchangeable bottom panel.
Figure 2:
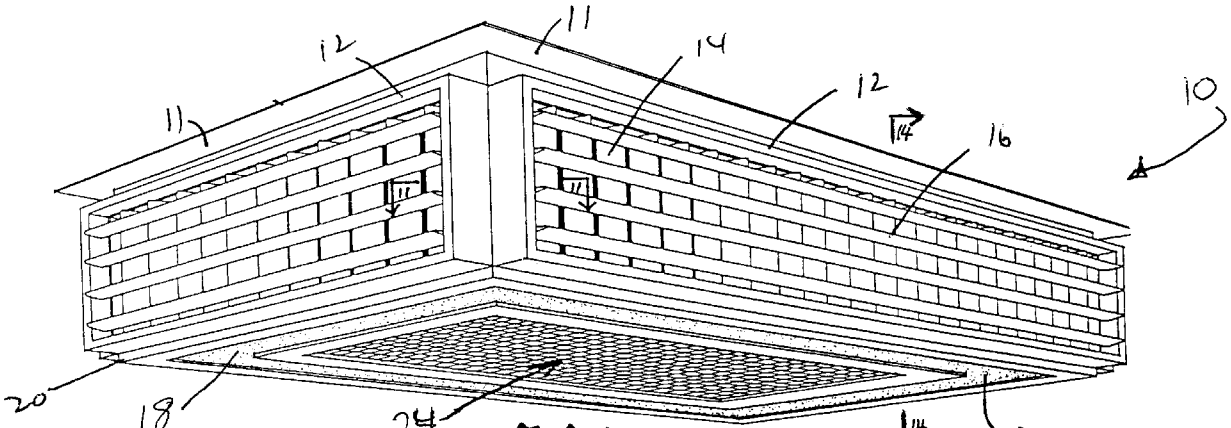
FIG. 2 is a perspective view illustrating another embodiment of a ceiling mounted automatic supply/return air diffuser, constructed in accordance with the present invention, with a partitioned grille bottom panel for receiving the return air.
Figure 3:
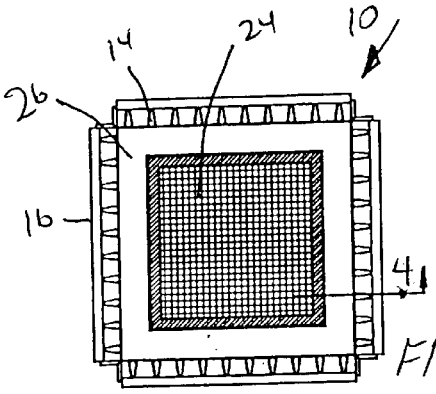
FIG. 3 is a plan view illustrating a nominal two (2') feet by two (2') feet automatic supply/return air diffuser, constructed in accordance with the present invention.

As illustrated in FIGS. 1 and 2, the air diffuser 10 of the present invention includes a module frame 12 having at least one deflection damper 14 vertically mounted therein and at least one trajectory vane 16 horizontally mounted therein. Both the deflection dampers 14 and the trajectory vanes 16 are pivotally mounted within the module frame 12 to direct conditioned air in a variety of directions. The operation and construction of the deflection dampers 14 and the trajectory vanes 16 will be discussed in further detail below.

Referring to FIG. 1, a first embodiment of the present invention, each air diffuser 10 is a low-pressure plenum modular air outlet having an interchangeable bottom panel 18 configured as an enclosed surface allowing the accumulation of static air pressure. The accumulation of static air pressure is sufficient to deliver a horizontal discharge of conditioned air from the outlet into a room or space. As understood by those skilled in the art, eight (8) nominal sized automatic supply modules can be used in multiples configuring at least seventeen (17) different ceiling air diffusers.

Figure 10:
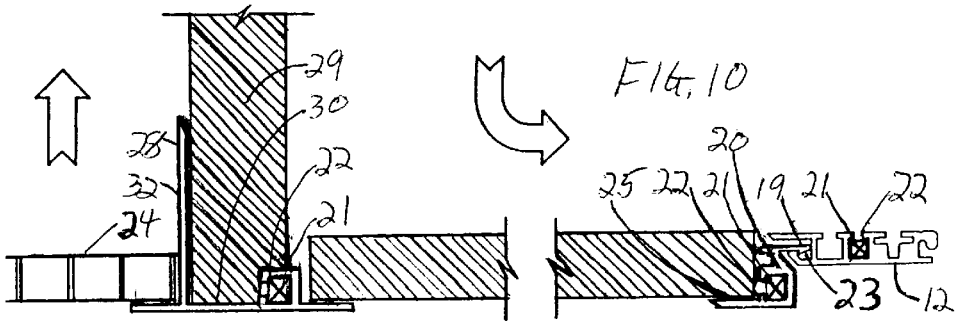
FIG. 10 is a sectional view illustrating an alternative embodiment of the automatic supply/return air diffuser, constructed in accordance with the present invention.

As illustrated in FIGS. 1, 2, and 10, the air diffuser 10 of the present invention includes a bottom panel frame 20 for receiving the interchangeable bottom panel 18. Preferably, the bottom panel frame 20 is an ell shaped channel 25 sized and shaped for releasably receiving the bottom panel 18. The bottom panel frame 20 of the air diffuser can actually receive a standard existing or modified ceiling panel 17 (FIG. 14) aesthetically matching the surrounding suspended ceiling. A primary function of the bottom panel frame 20 is to enable field assembly and disassembly of the latch end 19 with the bottom latch channel 23 of the module frame 12. When the latch end 19 is assembled with the bottom latch channel 23 of the opposing modules 12, the low-pressure plenum air outlet is locked together in an airtight operating position. Furthermore, the bottom panel frame 20 incorporates an open tee channel 22 to provide for the assembly of mitered frame members using four ell shaped barbed corner keys 21.

Figure 8:
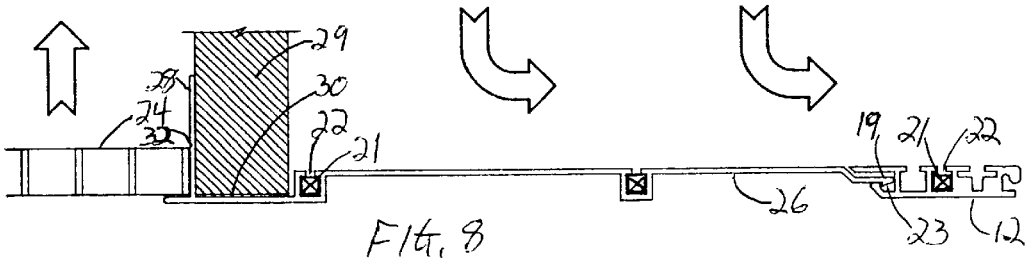
FIG. 8 is a sectional view illustrating the automatic supply/return air diffuser of FIG. 7 taken along line 8, constructed in accordance with the present invention.

As illustrated in FIGS. 2 and 8, in a second embodiment, the air diffuser 10 of the present invention is a low pressure plenum modular air outlet having at least a portion of the bottom being an open partitioned grille 24 surrounded by a non-partitioned extruded bottom panel 26. Each of three sizes of bottom panels 26 incorporate a latch end 19 to connect into the latch cavity 23 of the module frame 12, thereby securing opposing facing modules 12 of the air diffuser 10. Furthermore, the three extruded bottom panels 26 incorporate one or more open tee channels 22 to provide for the assembly of mitered frame members using four or more ell shaped barbed corner keys 21. The partitioned grille 24 of the air diffuser 10 allows for center vertical air return thereby inhibiting the horizontal discharge of conditioned supply air being short cycled into the return air of the mechanical conditioning system. As discussed, the air diffuser 10 of the present embodiment incorporates a surrounding flat non-partitioned extruded bottom panel 26 allowing the accumulation of supply static air pressure around a center return air duct sufficient to deliver a horizontal discharge of conditioned air from the outlet into a room or space. Eight (8) nominal size automatic supply modules are used in multiples configuring at least six (6) supply/return diffusers.

As illustrated in FIG. 10, the air diffuser 10 of the present invention includes a plenum/supply return air frame 28 having a channel 30 with an upward extending leg 32 to airtight connect an insulated sheet metal or fiberglass return air duct 29, which can be replaced with a different material. Furthermore, the plenum supply and return air frame 28 incorporates an open tee channel 22 to provide for the assembly of mitered frame members using four ell shaped barbed corner keys 21.

Figure 9:
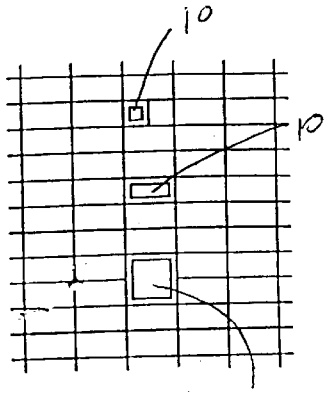
FIG. 9 is a plan view illustrating a grid ceiling with nominal two (2') feet by two (2') feet, two (2') feet by four (4') feet, and four (4') feet by four (4') feet air diffusers of FIGS. 3, 5, and 7.
Figure 5:
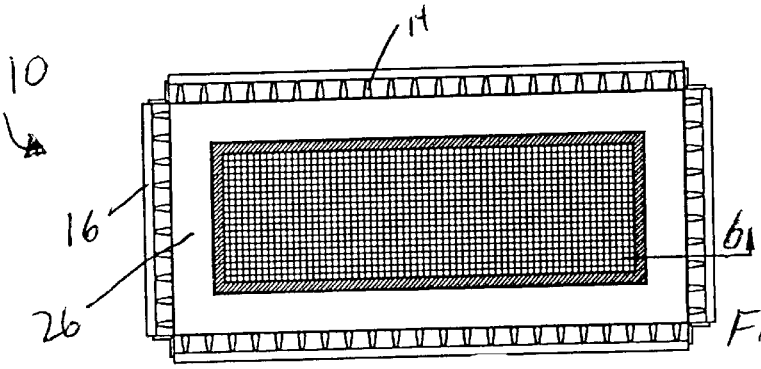
FIG. 5 is a plan view illustrating a nominal two (2') feet by four (4') feet automatic supply/return air diffuser, constructed in accordance with the present invention.
Figure 7:
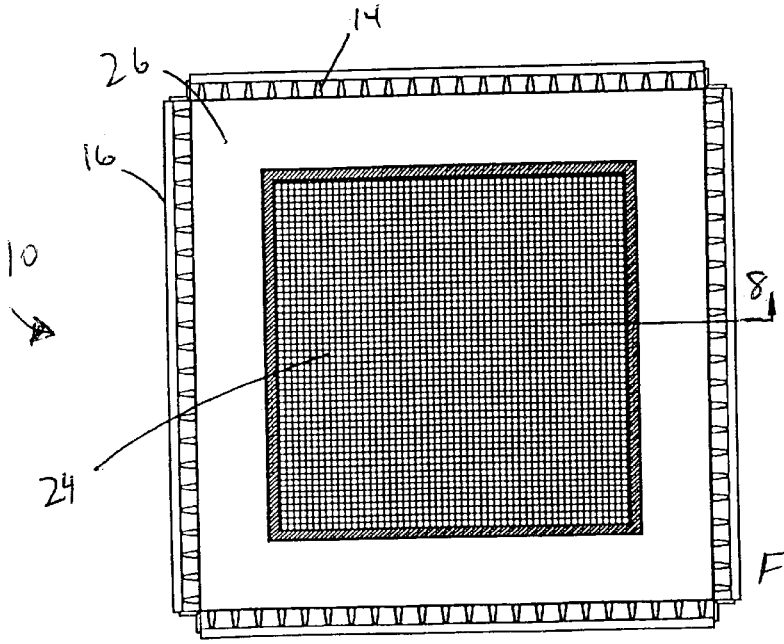
FIG. 7 is a top plan view illustrating a nominal four (4') feet by four (4') feet automatic supply/return air diffuser, constructed in accordance with the present invention.
Figure 4:
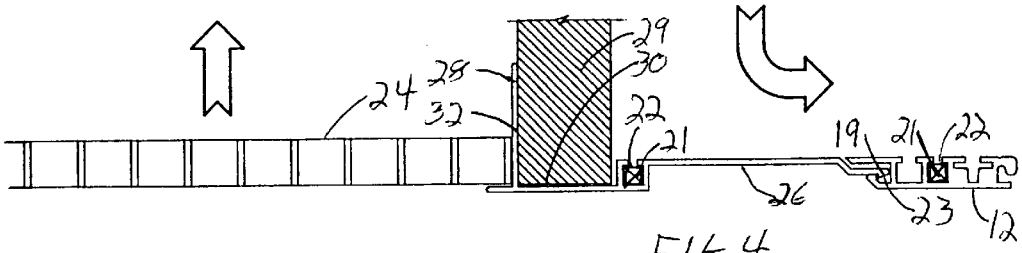
FIG. 4 is a sectional view illustrating the automatic supply/return air diffuser of FIG. 3 taken along line 4, constructed in accordance with the present invention.
Figure 6:
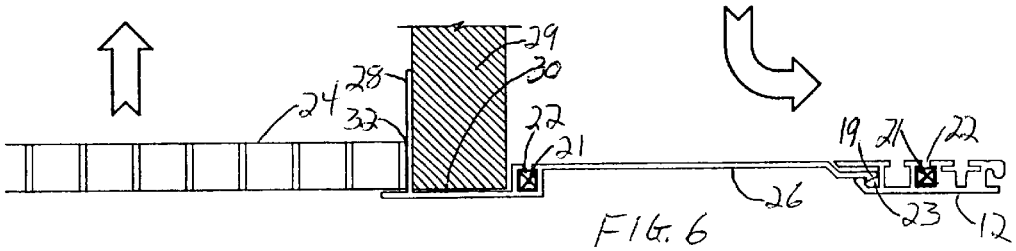
FIG. 6 is a sectional view illustrating the automatic supply/return air diffuser of FIG. 6 taken along line 6, constructed in accordance with the present invention.
Figure 14:
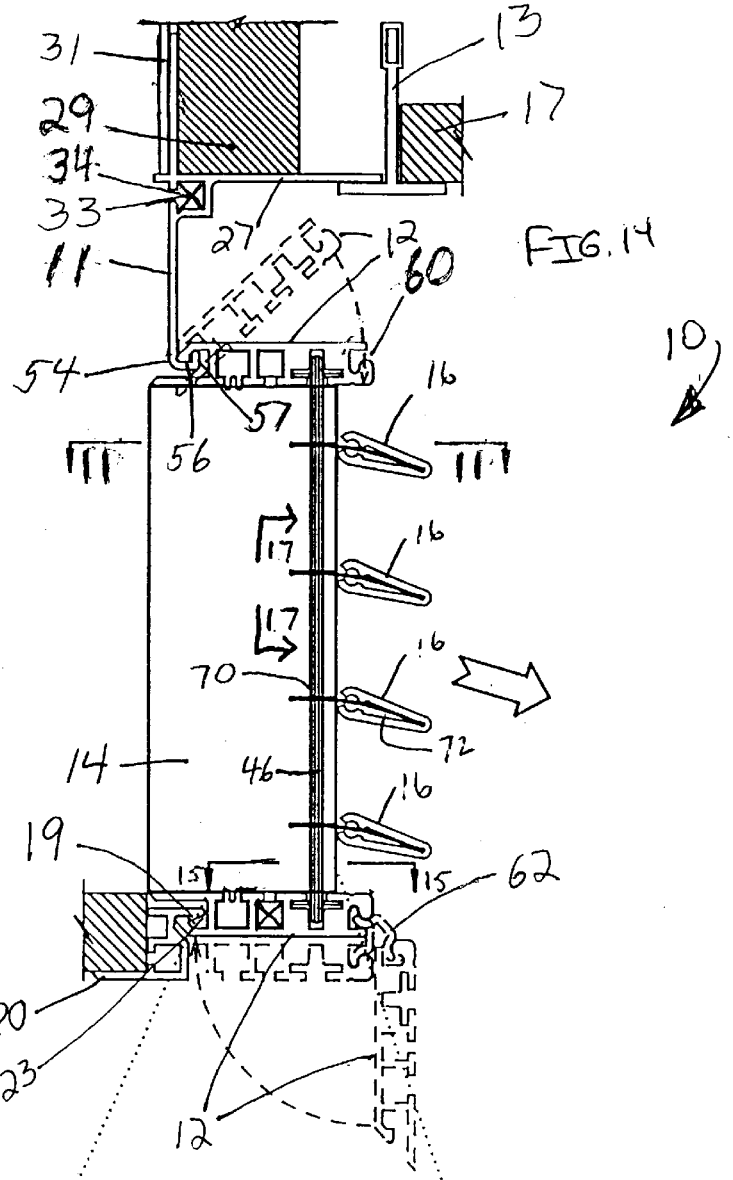
FIG. 14 is a sectional elevational view illustrating the ceiling mounted automatic supply/return air diffuser of FIGS. 1 and 2 taken along line 14, constructed in accordance with the present invention, with horizontally mounted, automatically adjustable trajectory vanes pivotally mounted within the module frame.

Referring directly to FIGS. 9 and 14, the mounting frame 11 of the air diffuser 10 of the present invention incorporates a single flange for support by the suspended ceiling grid 13 of the architectural structure allowing the air diffuser 10 to drop into a typical 2'×2', 2'×4', 4'×4', and 4'×8' suspended ceiling grid system 13, or nominal equivalent; metric sizes.

As illustrated in FIG. 14, the air diffuser 10 of the present invention includes the mounting frame 11 having an adequate standoff from the ceiling. This standoff of the mounting frame greatly reduces the entrainment of secondary room air and the subsequent deposits of smudge or dirt on the ceiling or near the conditioned air outlet.

The mounting frame 11 of the air diffuser 10 is also designed for direct connection to, and suspension by, a metal 31 or fiberglass 32 conditioned air duct without the support of any ceiling system. The mounting frame 11 has a downward angled leg 54 containing a latch channel 56 designed to receive and support a modular conditioned air outlet with a pivot locking and airtight connecting joint 57. Furthermore, the mounting frame 11 incorporates an open tee channel 34 to provide for the assembly of mitered frame members using four ell shaped barbed corner keys 33.

The modular frame design of the air diffuser 10 is designed to join the module frames 12 of adjacent air diffusers 10 by incorporating a latch channel 60 to allow a pivot locking and air tight connecting joint. A multiple assembly of air diffuser modules 10 in stacked and/or side-by-side plenum supply air diffusers configurations use a double-edged pivot locking and air sealing connector 62. The double-edged pivot locking and air sealing connector 62 with elongated edges and latches allow for the field assembly of two or more air diffuser modules 10. In fact, a variety of air diffuser module configurations allow the field expansion of air outlet capacity by adding modules to an existing plenum air outlet to satisfy increased load requirements of the room or space. No hand or power tools or fasteners for assembly of the air diffuser modules are required.

Figure 15:
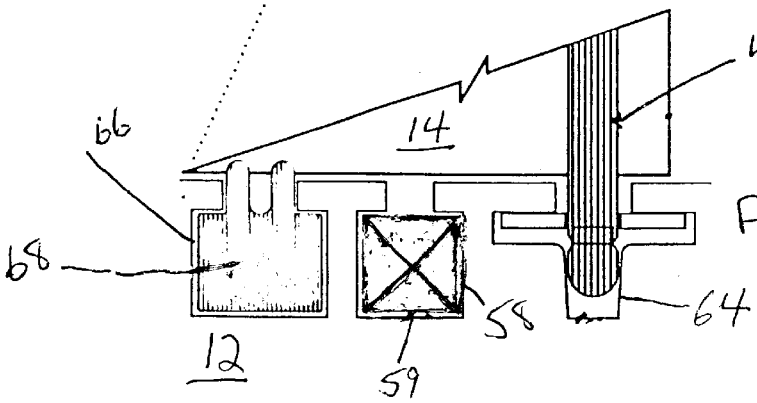
FIG. 15 is a sectional expanded view illustrating the ceiling mounted automatic plenum air diffuser of FIG. 14 taken along line 15, constructed in accordance with the present invention.
Figure 16:
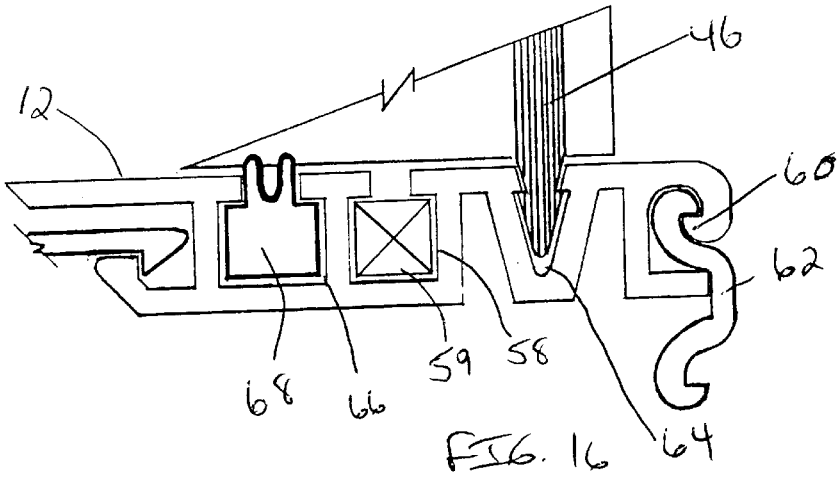
FIG. 16 is a sectional expanded view illustrating another embodiment of the automatic plenum air diffuser of FIG. 14 taken along line 15, constructed in accordance with the present invention.
Figure 17:
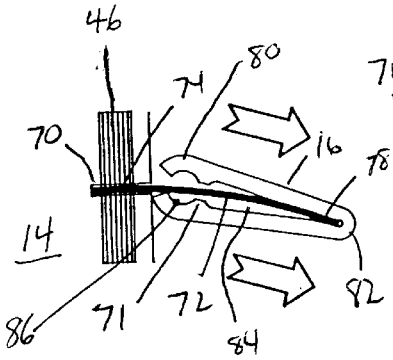
FIG. 17 is a sectional expanded view illustrating the ceiling mounted automatic plenum air diffuser of FIG. 14 taken along line 17, constructed in accordance with the present invention, with the trajectory vane being automatically directed in a substantially downward direction for the supply of heated air.
Figure 18:
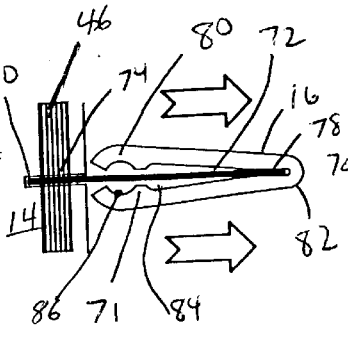
FIG. 18 is a sectional view illustrating the ceiling mounted automatic plenum air diffuser of FIG. 14 taken along line 17, constructed in accordance with the present invention, with the trajectory vane being automatically directed in a substantially horizontal direction for the supply of recirculated air.
Figure 19:
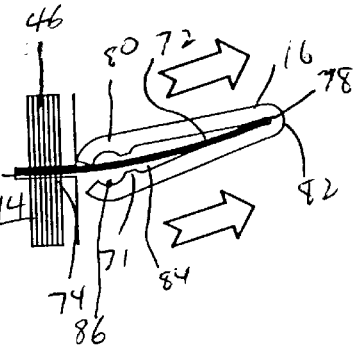
FIG. 19 is a sectional expanded view illustrating the ceiling mounted automatic air diffuser of FIG. 14 taken along line 17, constructed in accordance with the present invention, with the trajectory vane being automatically directed in a substantially upward direction for the supply of cooled air.

As illustrated in FIGS. 15 and 16, the module frame incorporates a tapered wall splineway 64 to properly space and align the axle pin 46 during assembly by compression. The deflection damper axle pin 46 with rounded (FIG. 15) or beveled and barbed ends (FIG. 16) align and fasten the pin into the module frame axle pin splineway 64 during assembly by compression. The axle pin 46 maintains tension between the top and bottom module frame members after assembly by compression.

Furthermore, the module frame incorporates an open tee channel 66 for providing a secure mounting for a friction strip 68 to maintain the desired position of the deflection dampers 14. The deflection damper friction strip 68 slides into the module frame channel 66 and has sufficient contact surface and durometer to maintain the full range of positions of the manually adjustable deflection dampers 14. The deflection damper 14 with the capability of each damper wall 36, 38 can be manually positioned or repositioned and held in place against movement by the air stream or from mechanical vibration by the friction strip 68 being engaged at the top and bottom ends of each of the deflection damper walls 36, 38. Furthermore, the module frame 12 incorporates an open tee channel 58 to provide for the assembly of mitered frame members using four ell shaped barbed corner keys 59.

Figure 11:
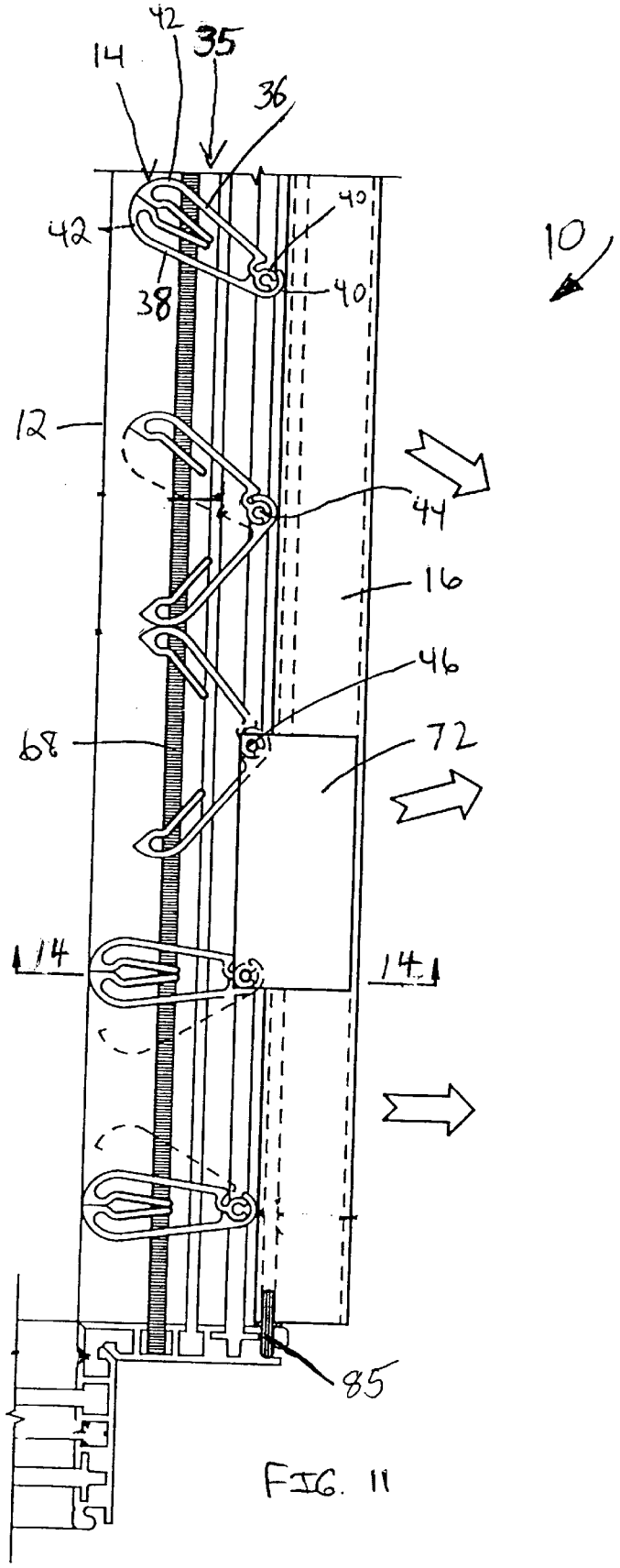
FIG. 11 is a sectional plan view illustrating the ceiling mounted automatic supply/return air diffuser of FIGS. 1 and 2 taken along line 11, constructed in accordance with the present invention, with horizontally mounted trajectory vanes and adjustable deflection dampers pivotally mounted vertically within a module frame.
Figure 12:
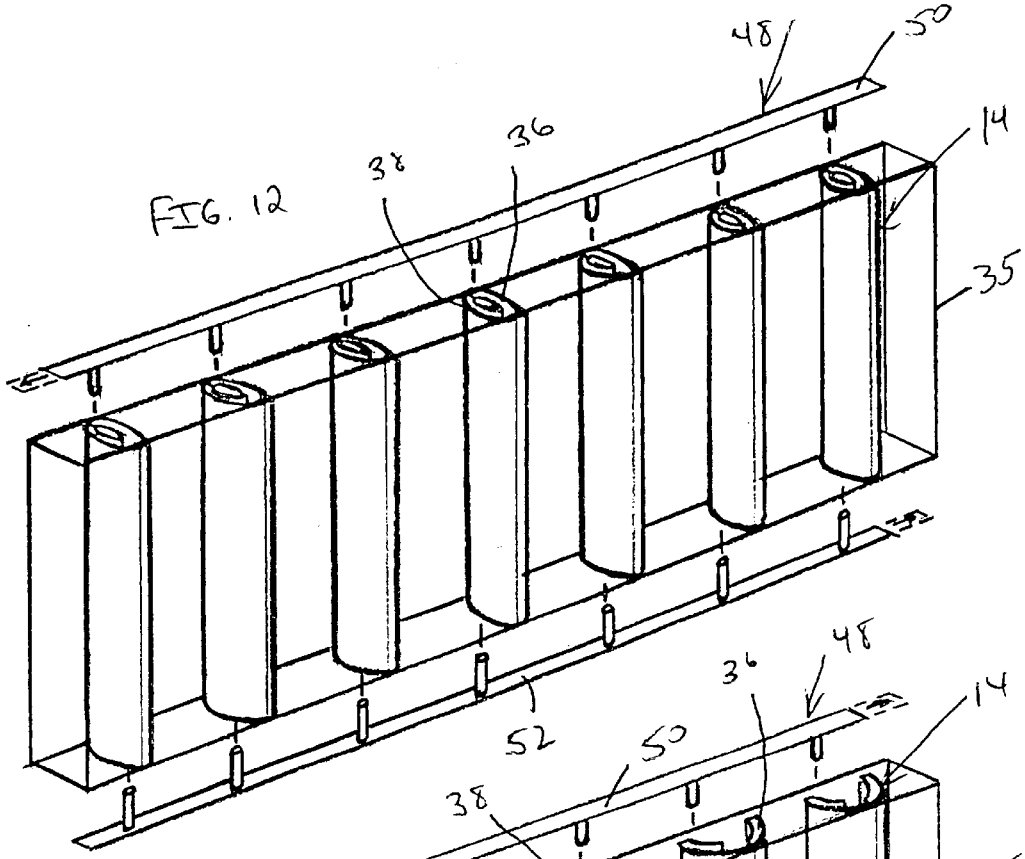
FIG. 12 is a perspective view of the deflection dampers in a substantially closed position for maximizing airflow therethrough, constructed in accordance with the present invention, with an adjusting mechanism for opening and closing the dampers at the outlet face or within a duct.
Figure 13:
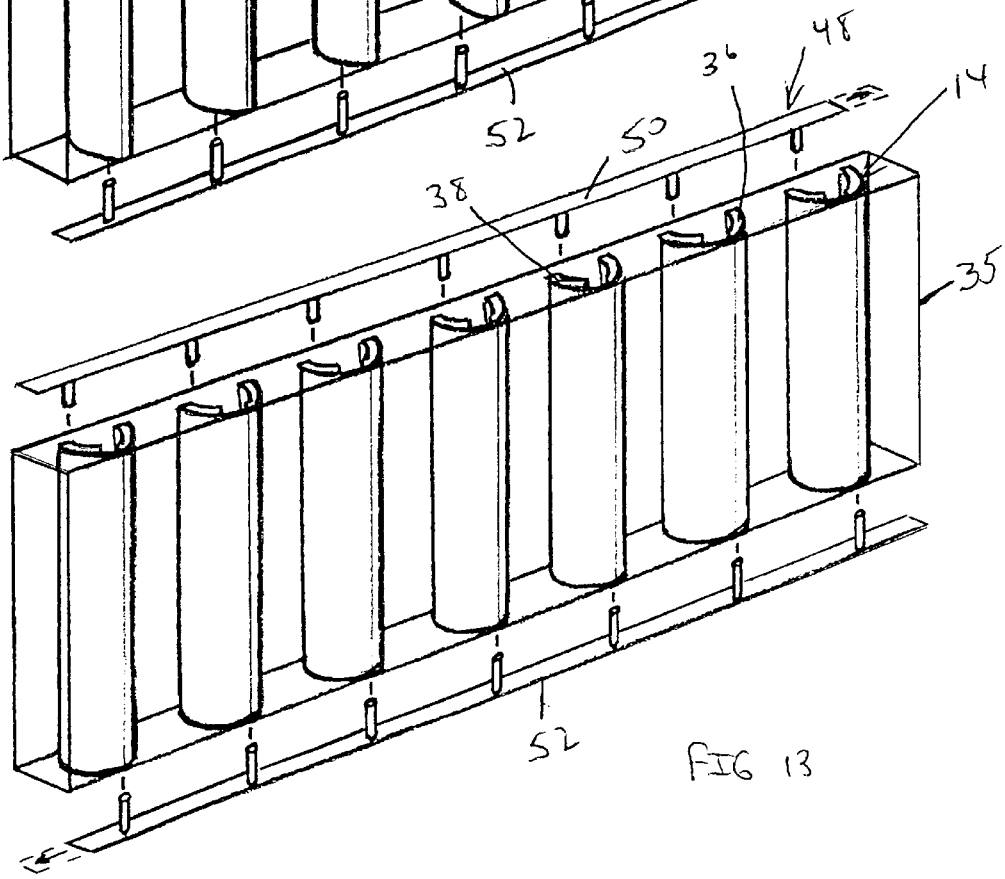
FIG. 13 is a perspective view of the deflection dampers in a substantially open position for minimizing the airflow therethrough, constructed in accordance with the present invention, with an adjusting mechanism for opening and closing the dampers at the outlet face or within a duct.

As illustrated in FIGS. 11–13, the air diffuser 10 of the present invention includes a deflection damper assembly 35 having at least one deflection damper 14 pivotally and vertically mounted relative to the module frame 12. Preferably, there are a plurality of deflection dampers 14 pivotally mounted along the horizontal length of the module frame 12.

Each deflection damper 14 has a first damper wall 36 and a second damper wall 38 independently pivotable relative to each other. Both the first damper wall 36 and the second damper wall 38 have a first end 40 and a second end 42 with the first end (male, end) 40 of the first damper wall 36 being positioned within the first end (female end) 40. to of the second damper wall 38 and mounted together in a pivoting fashion. When positioned together, the second ends 42 of the first damper wall 36 and the second damper wall 38 have a radius greater than the radius of the first ends 40 of the first damper wall 36 and the second damper wall 38. As illustrated, each deflection damper 14 is positioned such that the large radius of the second ends 42 of each deflection damper 14 is in first contact with the stream of conditioned supply air and the small radius of the first ends 40 of each deflection damper is positioned on the leaving or downstream edge.

The first damper wall 36 and the second damper wall 38 of each deflection damper 14 are moveable in a general direction toward and away from each other causing the airstream of conditioned air to eddy into the space between the large radius leading second ends 42 and first damper wall 36 and second damper wall 38 of the deflection damper 14. With the eddying airstream, the air is quietly cushioned and forms a larger radius of the leading second end 42 thereby providing an airfoil shape over the full range of air flow across each of the deflection dampers 14 in the deflection damper assembly 35.

Preferably, the deflection damper assembly 35 has an axle pin splineway 44 and extended cavity depth on the first or male end 40 of the first damper wall 36 and assembled along its length with a counterpart first or female end 40 of the second damper wall 38 allowing a maximum travel adjustment on the larger radius leading second ends 42. The deflection damper 14 is pivotable around an axle pin 46 inserted into the axle pin splineway 44 when used in multiples thereby allowing individual manual adjustment of the deflection damper 14 of the extended air flow surface for the precise control of the spread air pattern from zero (0°) degrees to one hundred and twenty (120°) degrees of angle to the outlet face of the conditioned supply air into a room or space.

Referring to FIGS. 12 and 13, the deflection dampers, when used in multiples at the outlet face or within a supply air duct, are connected by mechanically operated linkage 48. The deflection dampers 14 have all first damper walls 36 operated from a top linkage 50 and all second damper walls 38 operated from a bottom linkage 52 thereby providing the quiet reduction and dampening of air flow when located at the outlet face or inside an air duct. The deflection damper assembly 35 when used in multiples of deflection dampers 14 can be adjusted between maximum flow of conditioned supply air (FIG. 12) and reducing or completely stopping the flow of conditioned supply air (FIG. 13) between adjacent deflection dampers 14 with a directly corresponding reduction of the sound power level to the reduced air flow.

As illustrated in FIGS. 14 and 17–19, each deflection damper 14 has several horizontal slits 70 cut through the walls around the axle pin area for facilitating assembly and operation of a thermostatic bimetal device 72 while allowing free travel for the manual positioning of the deflection damper 14. The thermostatic bimetal device 72 has a first edge 74 mounted through the deflection damper slits 70 perpendicular to and secured by one or more axle pins 46 and a second edge 78 engaged with the multiple position trajectory vane 16. The thermostatic bimetal device 72 senses and responds to the changing temperature of conditioned supply air through a flexing cantilever mechanical action thereby arching and provides a maximum of trajectory travel between the bimetal edges 74, 78.

The multiple position trajectory vane 16 incorporates an internal splineway 84 to engage the trajectory travel edge-or second edge 78 of the thermostatic bimetal device 72. Each trajectory vane 16 has internal stand-off walls 71 which stabilize the trajectory vane 16 during high air flow conditions and causes additional trajectory travel when in contact with the arching surface of the thermostatic bimetal device 72.

In addition, each trajectory vane 16 incorporates an internal curved splineway 84 to mount and forms a bearing surface 86 to allow rotation of the trajectory vane 16. The trajectory vane mounting bearing surface 86 holds an axle pin 85 (FIG. 11) in each end of the multiple position trajectory vane 16 and having the opposite axle pin 85 end engaged into a socket in the module frame side members. Each multiple position trajectory vane 16, when pivoted on the vane mounting bearing 86 by the arching and flexing action of the thermostatic bimetal device 72, resets the trajectory of the air being discharged: downward for warmer air, horizontally for circulated air, and upwardly for cooler air.

The multiple position trajectory vane 16 has an airfoil shape with the large radius edge 80 in first contact with the stream of conditioned supply air and the small radius edge 82 as the leaving or downstream edge resulting in the reduction of eddies and accompanying sound power levels. The small radius downstream edge 82 reduces air eddies that cause drag and a pressure drop across the outlet face even with a high module face velocity.

Figure 20:
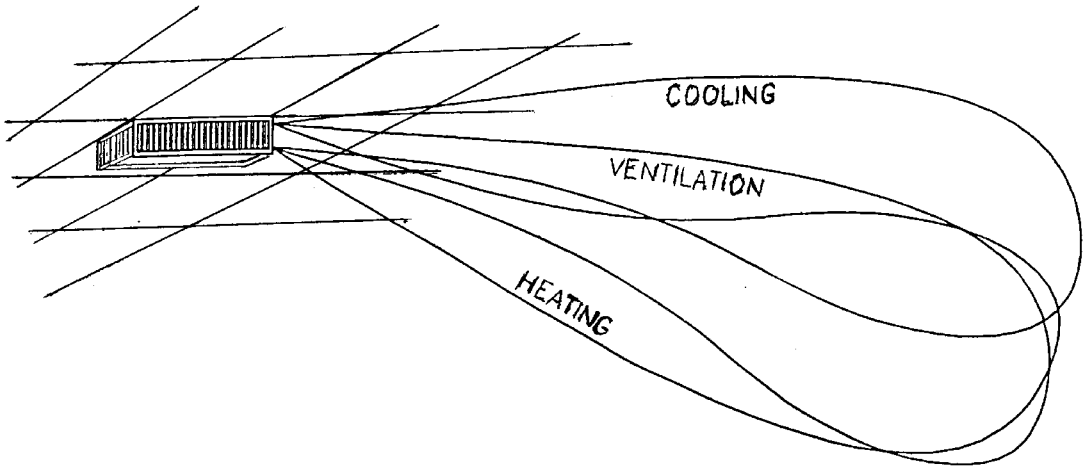
FIG. 20 is an elevational view illustrating the automatically adjusted supply air pattern trajectory.
Figure 22:
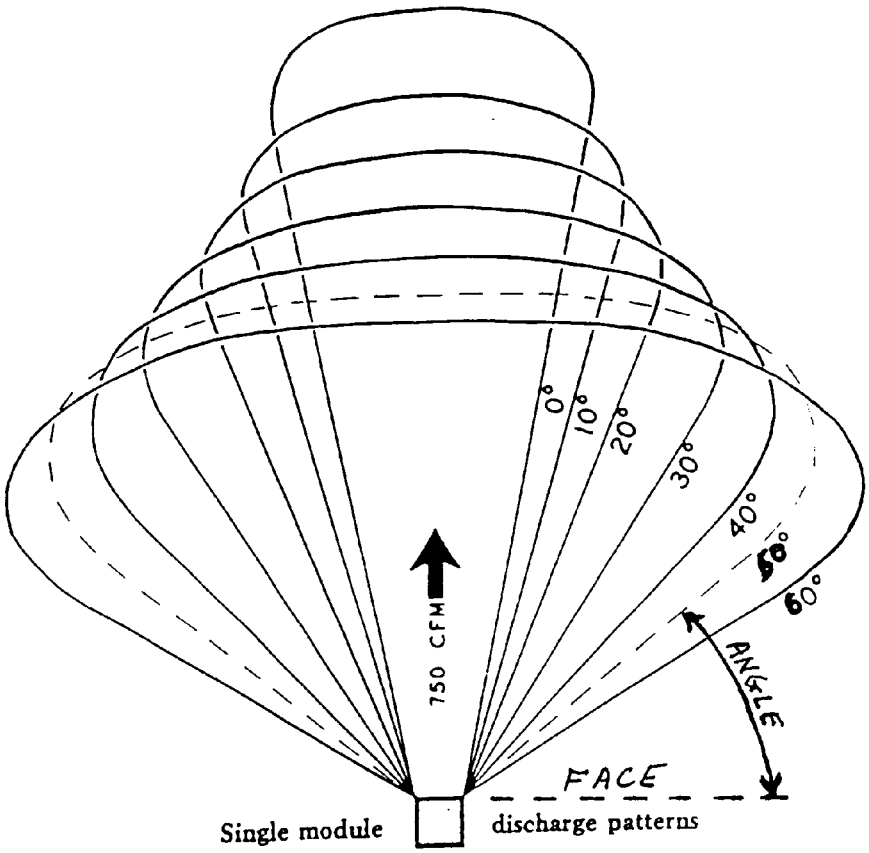
FIG. 22 is a schematic view illustrating the discharge pattern for a single module with the ceiling mounted automatic air diffuser.
Figure 23:
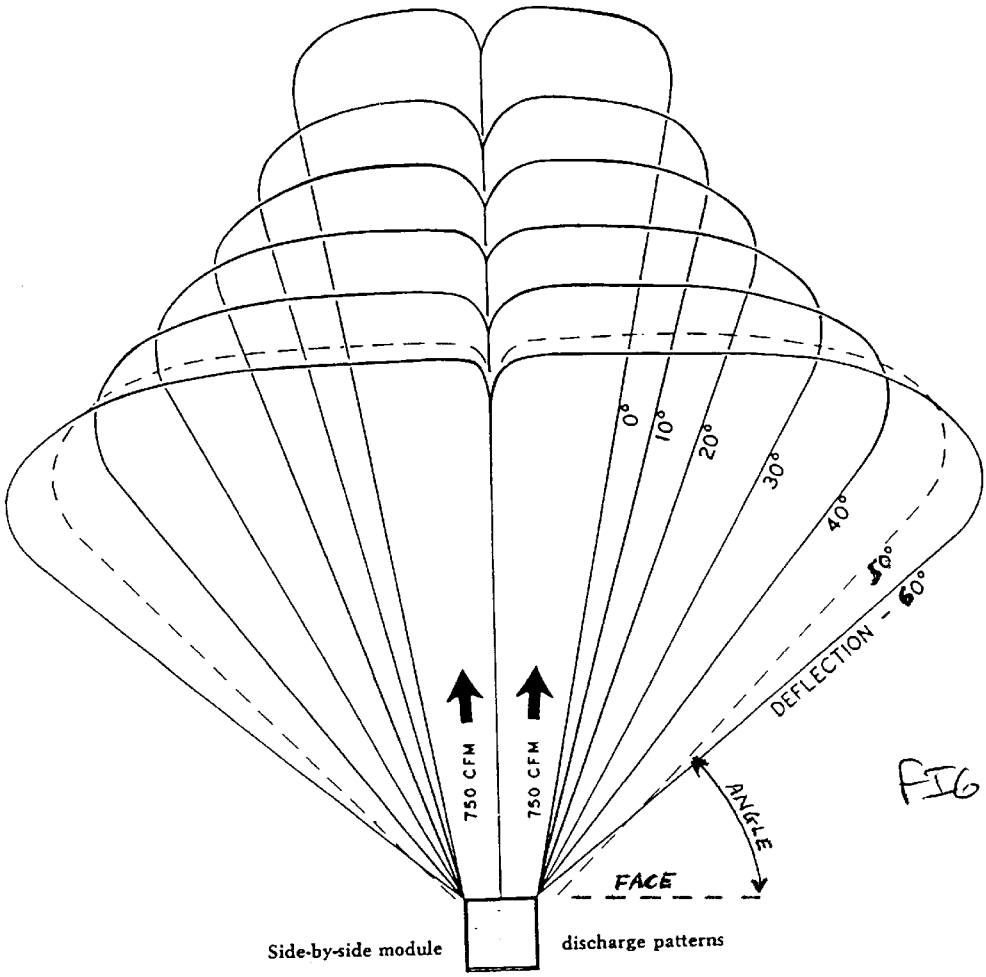
FIG. 23 is a schematic view illustrating the discharge pattern for a side-by-side module with the ceiling mounted automatic air diffuser.

With the air diffuser 10 of the present invention, as illustrated in FIGS. 20, 22, and 23, a low-pressure plenum or modular automatic register outlet provides an energy saving air pattern by properly directing the conditioned supply air automatically to the proper elevation zone of a room or space thereby reducing air temperature stratification and drafts in the occupied zone.

Figure 21:
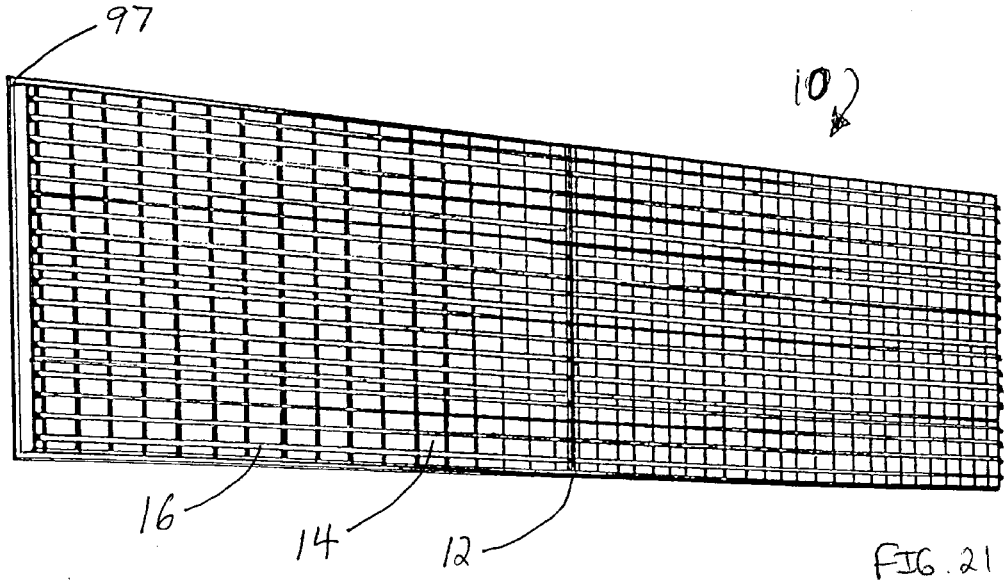
FIG. 21 is a perspective view illustrating the modular and automatic supply air register, constructed in accordance with the present invention.
Figure 27:
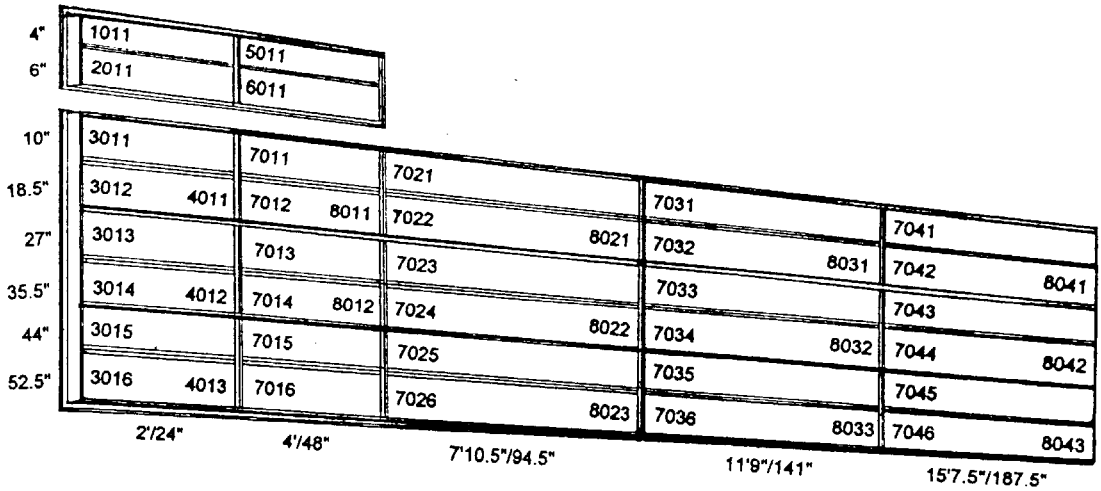
FIG. 27 is a perspective view illustrating a plurality of connected automatic supply registers or return air grilles, constructed in accordance with the present invention.

As illustrated in FIGS. 21 and 27, a flat surface single or multiple assembly of modules in stacked and/or side-by-side register configurations using the latch connector 62 to form an automatic register air outlet with inherent manually adjustable deflection dampers and automatic trajectory control. Eight nominal automatic supply modules are used in multiples to configure at least forty-one (41) modular automatic register outlets.

Figure 26:
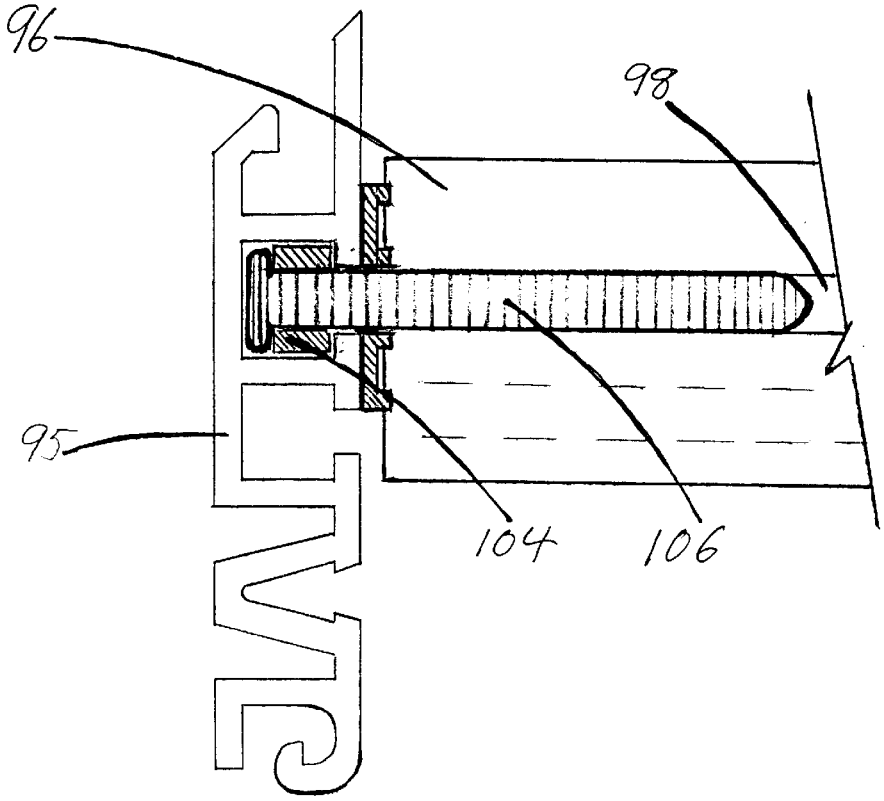
FIG. 26 is a sectional view illustrating an alternative embodiment of horizontal mounting of the return flow trajectory vanes, constructed in accordance with the present invention, with a barbed fastener.

As illustrated in FIG. 26, the return air grille modules 95 of the present invention includes a module frame 12, with alternative uses of the channels and internal splineways.

Figure 24:
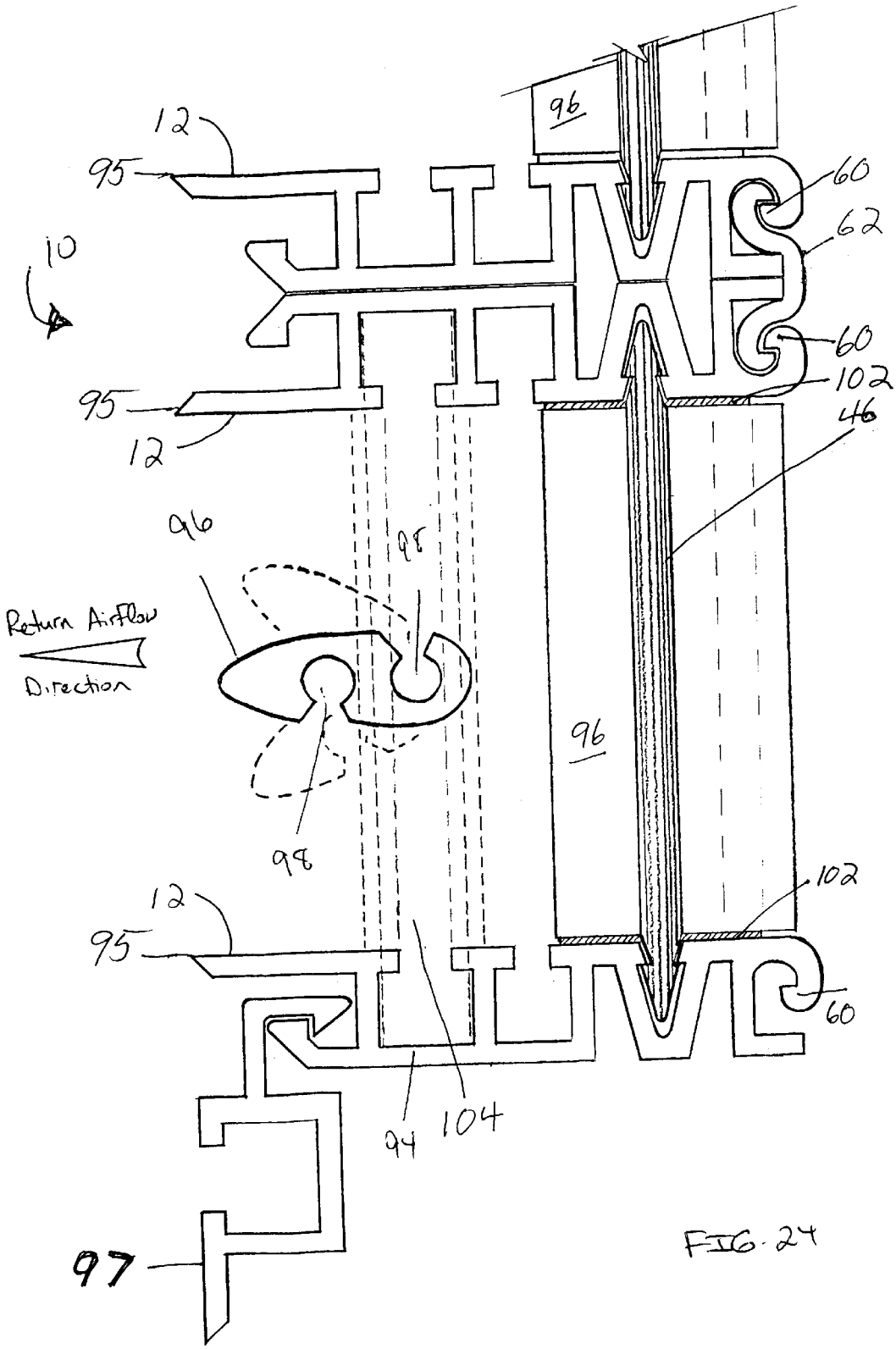
FIG. 24 is a sectional expanded view illustrating the return air module and the return airflow trajectory vanes, mounted horizontally and vertically within a module frame, constructed in accordance with the present invention.
Figure 28:
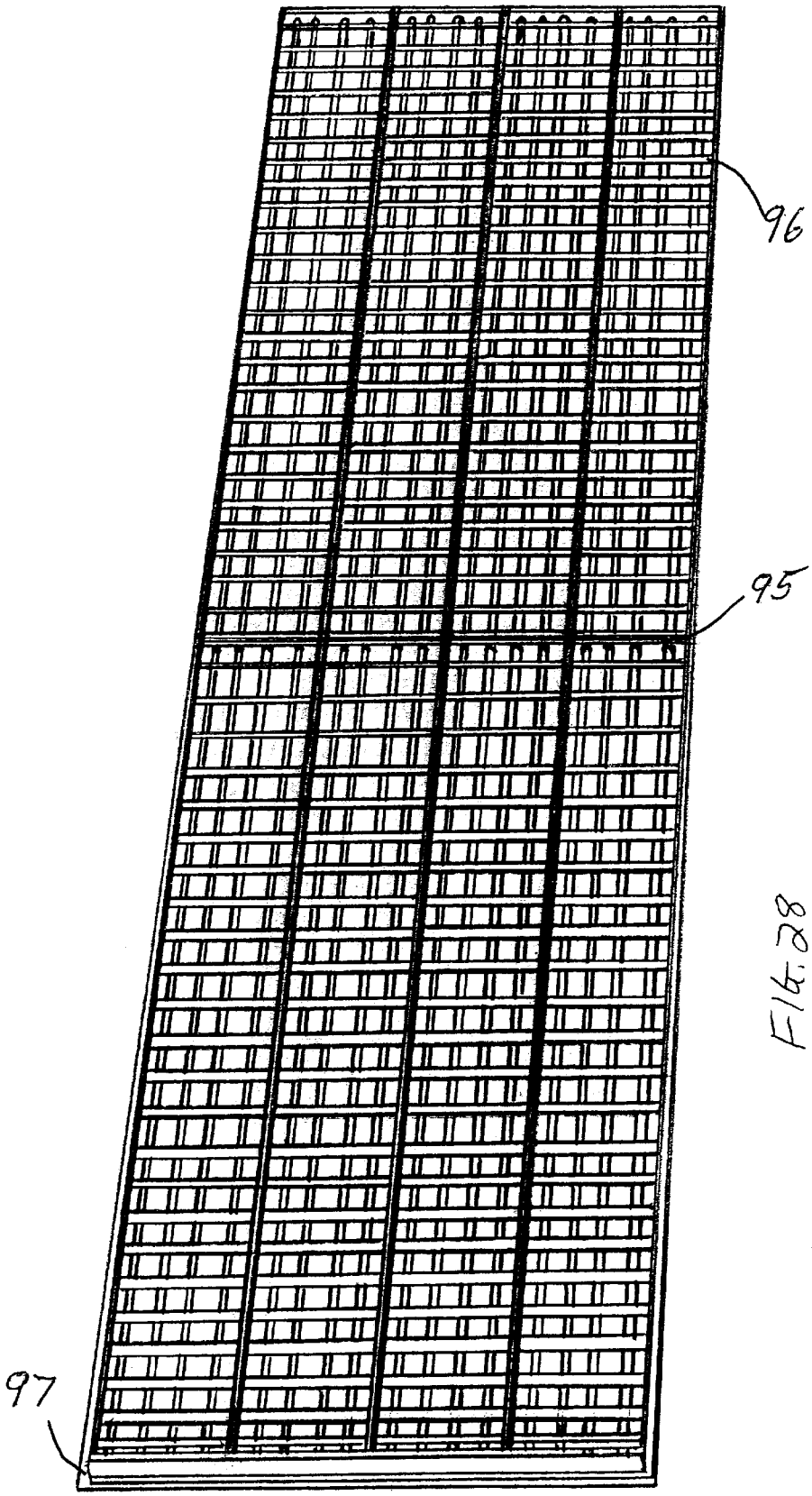
FIG. 28 is a perspective view illustrating the modular return air grille, constructed in accordance with the present invention.

As further illustrated in FIGS. 24, 27, and 28, a return air grille module 95 and return air vanes 96 can be used in multiple horizontal and/or vertical configurations. The return air vane 96 has a streamlined air profile and incorporating an internal splineway 98 for an axle pin 46 and axis mounting to the return air grille module 95. The return air vane 96 incorporates vertical and vertically inclined internal surfaces that provide additional elongated structural integrity beyond that of a solid profile.

Figure 25:
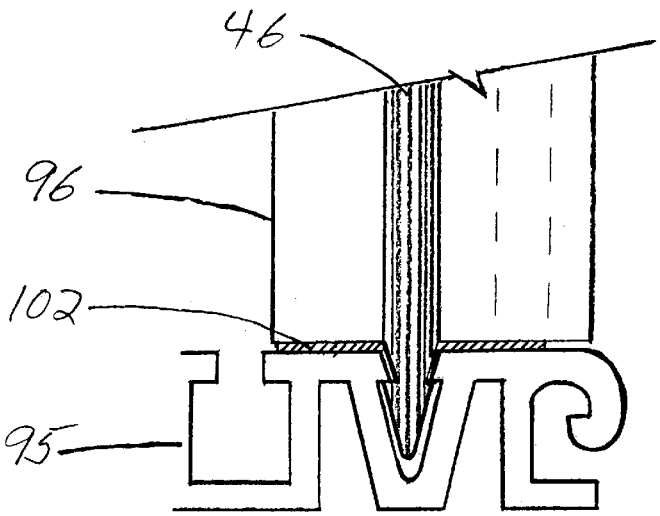
FIG. 25 is a sectional view illustrating the vertical mounting of the return airflow trajectory vanes, constructed in accordance with the present invention, with a friction washer for maintaining the position of the trajectory vanes.

As illustrated in FIGS. 24 and 25, the return air grille modules 95 of the present invention includes a return air vane friction washer 102 used at the mounting end of each vertical return air vane 96 having a sufficient diameter and durometer to allow field repositioning and to hold the set position of the return air vane 96 after assembly by compression.

As illustrated in FIG. 26, the return air grille modules 95 of the present invention includes mounting the return air vane 96 in a horizontal position by using a perforated friction strip 104 for the accurate spacing on the side members of the module with round shank pins 106 engaged into the ends of each return air vane splineway 98 and in a horizontal position during assembly by compression.

A flat surface single or multiple assembly of return air grille modules 95 in multiple stacked and/or side-by-side configurations using the pivot-locking and air sealing connector 62 (FIG. 24) and side wall mounting frame 97 (FIG. 24) form the return air grille. As illustrated in FIGS. 27 and 28, in multiples, four nominal size return air modules are used to configure at least forty-five (45) return air grilles. As further illustrated in FIGS. 27 and 28, common sizes of side wall mounting frames 97 are used for both the automatic register modules 12 and the return air grille modules 95, thereby reducing the product line inventory. The side wall mounting frame 97 can also be used for ceiling applications.

In sum, the present invention is an air diffuser outlet 10 for distributing conditioned air to interior spaces, with a multiple configuration and applications as supply air registers, supply air low pressure plenums, supply and return air diffusers, and return air grilles. The low pressure plenum modular air outlet 10 provides an energy saving air pattern by directing conditioned supply air to the proper elevation for mixing prior to the air entering an occupied zone thereby reducing air temperature stratification and drafts. Furthermore, the low pressure plenum modular air outlet 10 reduces the mechanical system blower motor horsepower and static pressure requirements by using fewer ducts and outlet locations substantially saving energy of air distribution for a given air quantity.

Means are provided to enable a common extrusion frame to mechanically and air tight connects supply or return air modules to various mounting frames or adjacent modules for multiple horizontal, vertical, or perpendicular applications. A module frame for the air diffuser 10 incorporates slide members angled to allow corner assembly with another module and forming an air pocket to prevent air leaking at the corners of a pressured plenum.

Each supply air module face has provision for manually adjusting the air pattern "spread" from zero (0°) degrees to one hundred and twenty (120°) degrees of angle to the outlet face (sixty (60°) degrees left, sixty (60°) degrees right), using a multiple of deflection dampers, which can also be set to manually control the air volume or "throw" from zero (0%) percent to one hundred (100%) percent, with a direct reduction of the sound power level-occurring as the volume is reduced or completely stopped, and having provisions for common linkage operators, when the deflection dampers are used in an air duct or supply frame module.

Each supply air module face also has provision to automatically sense the temperature of the stream of conditioned air being supplied to a room or space, and respond by adjusting the "drop" air pattern to a downward trajectory for warm air, a horizontal trajectory for circulated air, or an upward trajectory for cool air, thereby reducing or eliminating drafts in the occupied zone.

Four-sided low pressure plenum applications with integral deflection dampers provide three hundred and sixty (360°) degree manual control of the air pattern spread and volume, providing an optional one, two, three, or four way discharge, and automatic horizontal air pattern trajectory response and adjustment to temperature change-over from heating to cooling.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An air diffuser module for use as a part of an outlet, plenum, or register for conditioned air and to support, be supported by, or connected to another part of the outlet, the module comprising:

a module frame;

at least one deflection damper pivotally mounted vertically within the module frame, each deflection damper having a first damper wall and a second damper wall, the first damper wall being bent around in a general direction toward itself forming a first wall portion and a first flange portion substantially parallel to each other and the second damper wall being bent around in a general direction toward itself forming a second wall portion and a second flange portion substantially parallel to each other thereby forming a first air entrapment area between the first wall portion and the first flange portion and a second air entrapment area between the second wall portion and the second flange portion;

at least one trajectory vane pivotally mounted horizontally within the module frame; and adjusting means secured within each trajectory vane for adjusting the angle of each trajectory vane relative to the module frame responding to the temperature of the supply conditioned air;

thereby providing an energy saving air pattern by directing conditioned supply air to the proper elevation for mixing prior to the air entering an occupied zone and thereby reducing air temperature stratification.

2. The air diffuser module of claim 1 wherein each deflection damper has a first damper wall and a second damper wall, each having a first end and a second end with the first ends of each damper wall being mounted together about a common pivot point such that the second ends of each damper wall are moveable in a general direction toward and away from each other.

3. The air diffuser module of claim 2 wherein, when positioned together, the second ends of the first damper wall and the second damper walls have a radius greater than the radius of the first ends of the first damper wall and the second damper wall, the second ends of each deflection damper being in first contact with the stream of conditioned air.

4. The air diffuser module of claim 1 wherein each deflection damper is adjustable for a spread air pattern from zero (0°) degrees to one hundred and twenty (120°) degrees of angle.

5. The air diffuser module of claim 1 wherein adjacent deflection dampers are adjustable to reduce or completely stop the flow of conditioned supply air between adjacent deflection dampers resulting in a directly corresponding reduction of the sound power level to the flow of supply air.

6. The air diffuser module of claim 1 wherein the multiple position trajectory vane adjusting means is a thermostatic bimetal strip securing each trajectory vane to the module frame.

7. The air diffuser module of claim 6 wherein each trajectory vane has internal stand-off walls for stabilizing each trajectory vane and causing additional trajectory travel when in contact with an arching surface of the thermostatic bimetal.

8. The air diffuser module of claim 6 wherein the arching and flexing action of the thermostatic bimetal resets the trajectory of the air being discharged: downward for warmer air, horizontally for circulated air and upward for cooler air.

9. The air diffuser module of claim 1 wherein each trajectory vane has a substantially airfoil shape with a large radius edge in first contact with the stream of conditioned air.

10. The air diffuser module of claim 1 and further comprising:

connection means for connecting adjacent module frames wherein the connection means includes a double-edged pivot locking and air sealing connector having elongated edges and latches for allowing field assembly of two or more air diffuser modules.

11. The air diffuser module of claim 1 wherein eight modules are usable in multiples to configure at least sixty-four (64) distinct ceiling diffusers or sidewall registers.

12. The air diffuser module of claim 1 and further comprising:

at least one horizontal return vane and at least one vertical return vane for configuring a return air module.

13. The air diffuser module of claim 12 wherein four return air modules are usable in multiples to configure at least forty-five (45) distinct return air grilles.

14. An air diffuser for directing conditioned air, the air diffuser comprising:

vertical directing means for directing the conditioned air;

horizontal directing means for directing the conditioned air, the horizontal directing means having a first wall and a second wall; and thermostatic bimetal adjusting means associated with the horizontal directing means and secured between the first wall and the second wall for moving the horizontal directing means in an upward or downward direction responding to the temperature of the supply conditioned air;

thereby reducing mechanical system blower motor horsepower and static pressure requirements by using fewer ducts and outlet locations substantially saving energy of air distribution for a given air quantity.

15. The air diffuser of claim 14 wherein the vertical directing means includes at least one damper, each damper having a first damper wall pivotally connected to a second damper wall at one end, the other ends of the damper walls movable toward and away from each other.

16. The air diffuser of claim 15 the second ends of the first damper wall and the second damper walls have a radius greater than the radius of the first ends of the first damper wall and the second damper wall, the second ends of each damper being in first contact with the stream of conditioned air.

17. The air diffuser of claim 15 wherein adjacent deflection dampers are adjustable to reduce or completely stop the flow of conditioned supply air between adjacent deflection dampers.

18. The air diffuser of claim 14 wherein the horizontal directing means includes at least one trajectory vane.

19. A method of directing conditioned air, the method comprising:

providing at least one trajectory vane having a first wall and a second wall;

encasing at least a portion of a thermostatic bimetal strip between the first wall and the second wall within each trajectory vane;

directing the conditioned air across the trajectory vane;

automatically moving the trajectory vane in a generally downward manner for heated conditioned air; and automatically moving the trajectory vane in a generally upward manner for cooled conditioned air.

20. The method of claim 19 and further comprising:

providing at least one adjustable damper vane; and manually adjusting the damper vane to control the amount of air flow.

21. The method of claim 20 and further comprising:

a first damper wall and a second damper wall on each damper vane with each having a first end and a second end;

pivotally connecting the first ends of each damper; and manually moving the second ends of each damper wall in a general direction toward and away from each other to achieve the desired air flow volume.

22. The air diffuser module of claim 2 and further comprising:

a plurality of deflection dampers; and a first linkage mechanism connecting the second ends of the first damper walls together;

wherein upon movement of the first linkage mechanism in a first direction, the second ends of the first damper walls are moved in a general direction away from the second ends of the second damper walls;

wherein upon movement of the first linkage mechanism in a second direction, the second ends of the first damper walls are moved in a general direction toward the second ends of the second damper walls.

23. The air diffuser module of claim 2 and further comprising:

a plurality of deflection dampers; and a second linkage mechanism connecting the second ends of the second damper walls together;

wherein upon movement of the second linkage mechanism in a first direction, the second ends of the second damper walls are moved in a general direction away from the second ends of the first damper walls;

wherein upon movement of the second linkage mechanism in a second direction, the second ends of the second damper walls are moved in a general direction toward the second ends of the first damper walls.

24. The air diffuser module of claim 2 and further comprising:

an axle pin extending through the common pivot point;

wherein the adjusting means is secured to the axle pin.

25. An air diffuser module for use as a part of an outlet, plenum, or register for conditioned air and to support, be supported by, or connected to another part of the outlet, the module comprising:

a module frame;

at least one deflection damper pivotally mounted vertically within the module frame;

at least one trajectory vane pivotally mounted horizontally within the module frame, each trajectory vane having internal stand-off walls for stabilizing each trajectory vane and causing additional trajectory travel when in contact with an arching surface of the thermostatic bimetal; and a thermostatic bimetal strip secured win each trajectory vane for adjusting the angle of each trajectory vane relative to the module frame responding to the temperature of the supply conditioned air;

thereby providing an energy saving air pattern by directing conditioned supply air to the proper elevation for mixing prior to the air entering an occupied zone and thereby reducing air temperature stratification.

* * * * *